US010323839B1

(12) United States Patent
Huynh et al.

(10) Patent No.: US 10,323,839 B1
(45) Date of Patent: Jun. 18, 2019

(54) LED LIGHT ASSEMBLY HAVING AXIALLY COUPLED LED LIGHT MODULES

(71) Applicant: MAXLITE, INC., West Caldwell, NJ (US)

(72) Inventors: Patrick Huynh, Long Beach, CA (US); James Steedly, Menifee, CA (US)

(73) Assignee: MAXLITE, INC., West Caldwell, NJ (US)

( * ) Notice: Subject to any disclaimer, the term of this patent is extended or adjusted under 35 U.S.C. 154(b) by 0 days.

(21) Appl. No.: 14/689,199

(22) Filed: Apr. 17, 2015

Related U.S. Application Data

(60) Provisional application No. 61/980,826, filed on Apr. 17, 2014.

(51) Int. Cl.
*F21V 29/74* (2015.01)
*F21K 99/00* (2016.01)
*F21Y 101/02* (2006.01)

(52) U.S. Cl.
CPC ..... *F21V 29/74* (2015.01); *F21K 9/30* (2013.01); *F21V 29/745* (2015.01); *F21Y 2101/02* (2013.01)

(58) Field of Classification Search
CPC ..... F21V 29/20; F21V 29/74; F21V 29/2212; F21V 29/83; F21V 17/108; F21V 17/14; F21V 29/745; F21V 29/75
USPC ..... 362/294
See application file for complete search history.

(56) References Cited

U.S. PATENT DOCUMENTS 6,154,362 A * 11/2000 Takahashi ..... G09F 9/33 257/E25.028
6,578,978 B1 * 6/2003 Upton ..... A47F 3/001 362/125
2012/0087118 A1 * 4/2012 Bailey ..... F21V 31/005 362/235
2012/0127702 A1 * 5/2012 Lax ..... F21S 8/043 362/184
2012/0147603 A1 * 6/2012 Hochstein ..... F21V 29/004 362/247
2012/0261105 A1 * 10/2012 Lin ..... F21V 29/76 165/185
2013/0088871 A1 * 4/2013 Yun ..... F21S 4/28 362/249.01
2013/0207542 A1 * 8/2013 Watanabe ..... F21V 29/26 315/32
2014/0036504 A1 * 2/2014 Kim ..... F21V 27/02 362/249.02
2014/0182662 A1 * 7/2014 West ..... H02S 30/10 136/251
2014/0328064 A1 * 11/2014 Mikami ..... F21V 29/74 362/249.01
2016/0018095 A1 * 1/2016 Deshpande ..... F21V 29/83 362/373

* cited by examiner

*Primary Examiner* — Gerald J Sufleta, II
(74) *Attorney, Agent, or Firm* — Budzyn IP Law, LLC

(57) ABSTRACT

In a first aspect of the subject invention, an LED light assembly is provided comprising: a housing; and, a plurality of LED light modules coupled together in axial end-to-end fashion so as to define an elongated lighting strip, each said light module including at least one heat dissipation block and at least one LED element, wherein, said lighting strip is secured to said housing.

14 Claims, 16 Drawing Sheets

LED LIGHT ASSEMBLY HAVING AXIALLY COUPLED LED LIGHT MODULES

CROSS-REFERENCE TO RELATED APPLICATION

This application claims priority to U.S. Provisional Patent Application No. 61/980,826, filed Apr. 17, 2014, the entire contents of which are incorporated by reference herein.

BACKGROUND OF THE INVENTION

Light emitting diode (LED) street lamps are well known in the art. Such street lamps are configured with various constructions to provide different light distribution patterns in accordance with various codes and requirements. As shown in FIGS. 1 and 2, a standard prior art design includes a frame-shaped housing in which a plurality of LED light modules are supported. The light modules each include an LED lighting element mounted to a heat dissipation block. The LED driver is controlled within the housing and electronically coupled to the LED elements using any known technique. The housings are configured so as to provide edge support to the modules with the modules being aligned side-by-side. With a single-column array, as shown in FIGS. 1 and 2, each module spans an open lighting window defined by the frame. One or more intermediate dividers may be provided, as shown in FIG. 3, which provide support for a multi-column array within the lighting window. Optical lenses may be provided with one or more of the light modules (covering the LED elements) to widen or otherwise distort a light distribution pattern. Such widening and/or distortion may be in single or multiple direction(s).

SUMMARY OF THE INVENTION

In a first aspect of the subject invention, an LED light assembly is provided comprising: a housing; and, a plurality of LED light modules coupled together in axial end-to-end fashion so as to define an elongated lighting strip, each said light module including at least one heat dissipation block and at least one LED element, wherein, said lighting strip is secured to said housing.

In a further aspect of the subject invention, an LED light assembly is provided comprising: a housing; at least one LED light module having an heat dissipation block and at least one LED element, at least one channel being defined through said heat dissipation block; and, at least one support formed to pass through said at least one channel, wherein, said light module is secured to said housing with said at least one support passing through said at least one channel.

In yet a further aspect of the subject invention, an LED light assembly is provided comprising: a housing having a mounting wall; at least one LED light module including at least one heat dissipation block and at least one LED element, wherein, said lighting strip is secured to said housing, and, wherein said heat dissipation block of at least one said light module is canted so that with placement of said canted heat dissipation block against said mounting wall, the corresponding said at least one LED element is disposed in a plane not perpendicular to the plane of said mounting wall.

In yet a further aspect of the subject invention, a LED module is provided comprising: a base; at least one LED element secured to said base; and, a plurality of fins extending from said base opposite said at least one LED element, wherein, portions of at least one said fin adjacent to said base defines protrusions.

These and other features of the invention will be better understood through a study of the following detailed description and accompanying drawings.

DETAILED DESCRIPTION OF THE INVENTION

Figure 1:
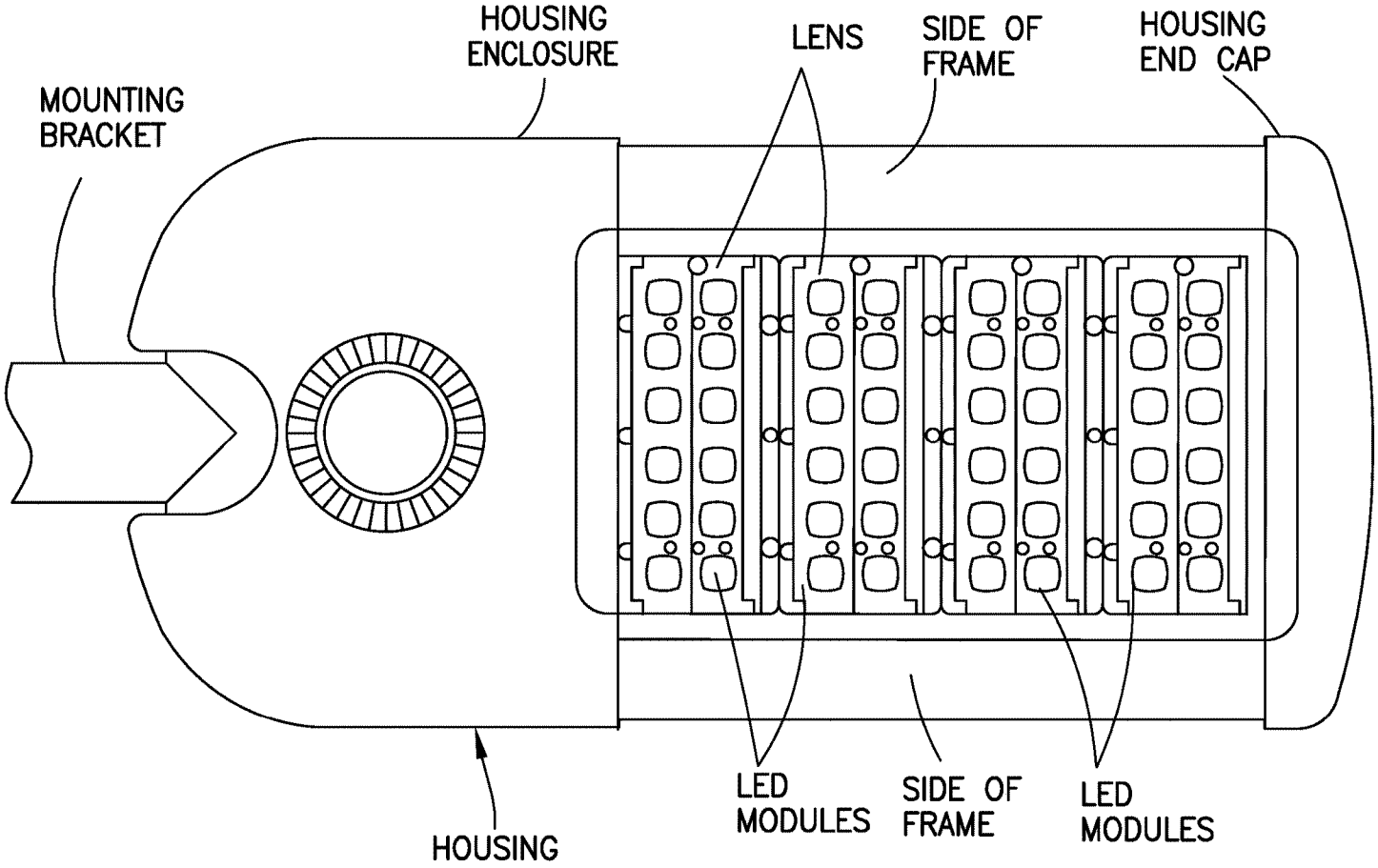
FIGS. 1-3 show prior art LED module lighting arrangements.
Figure 2:
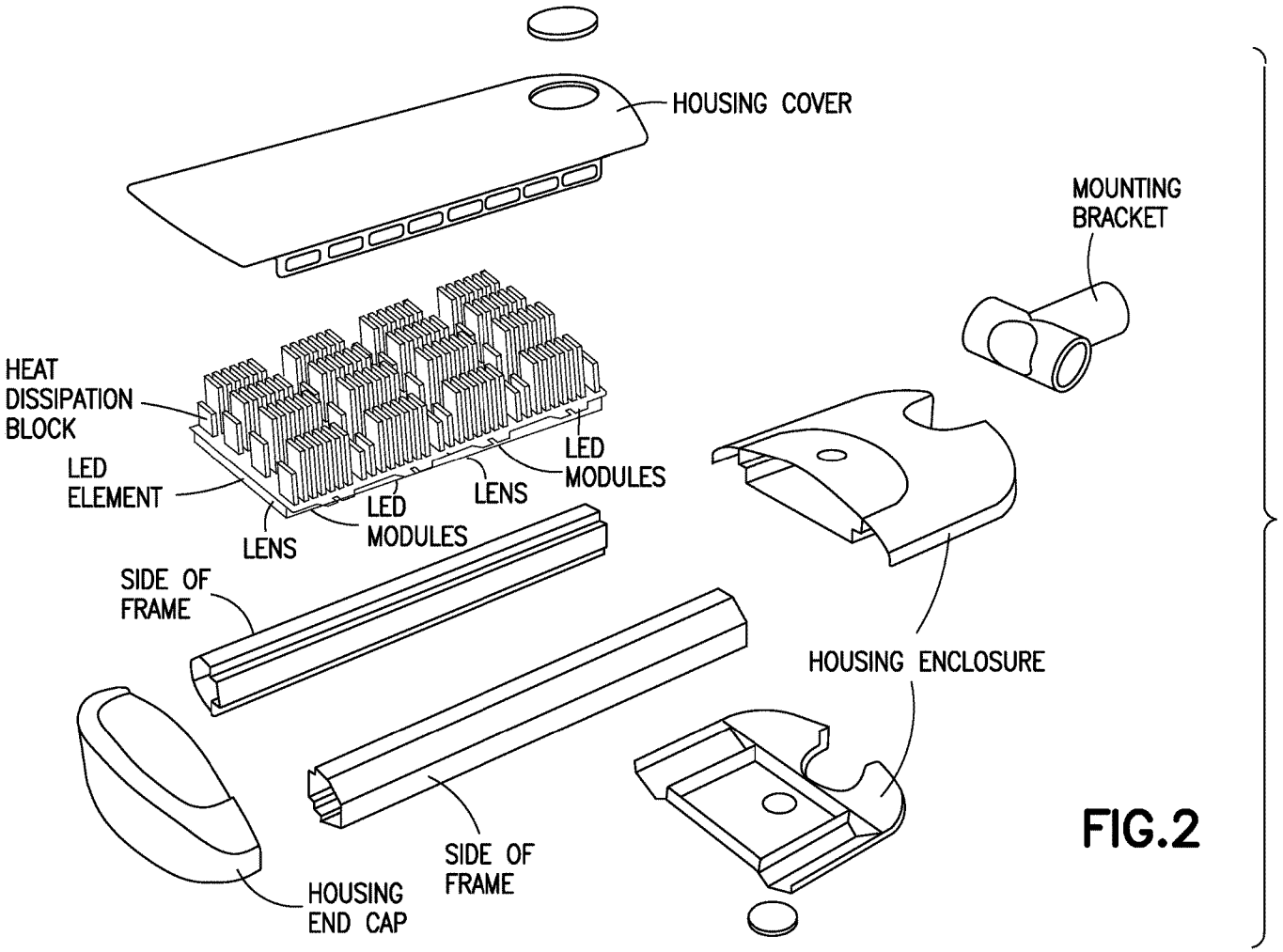
Figure 3:
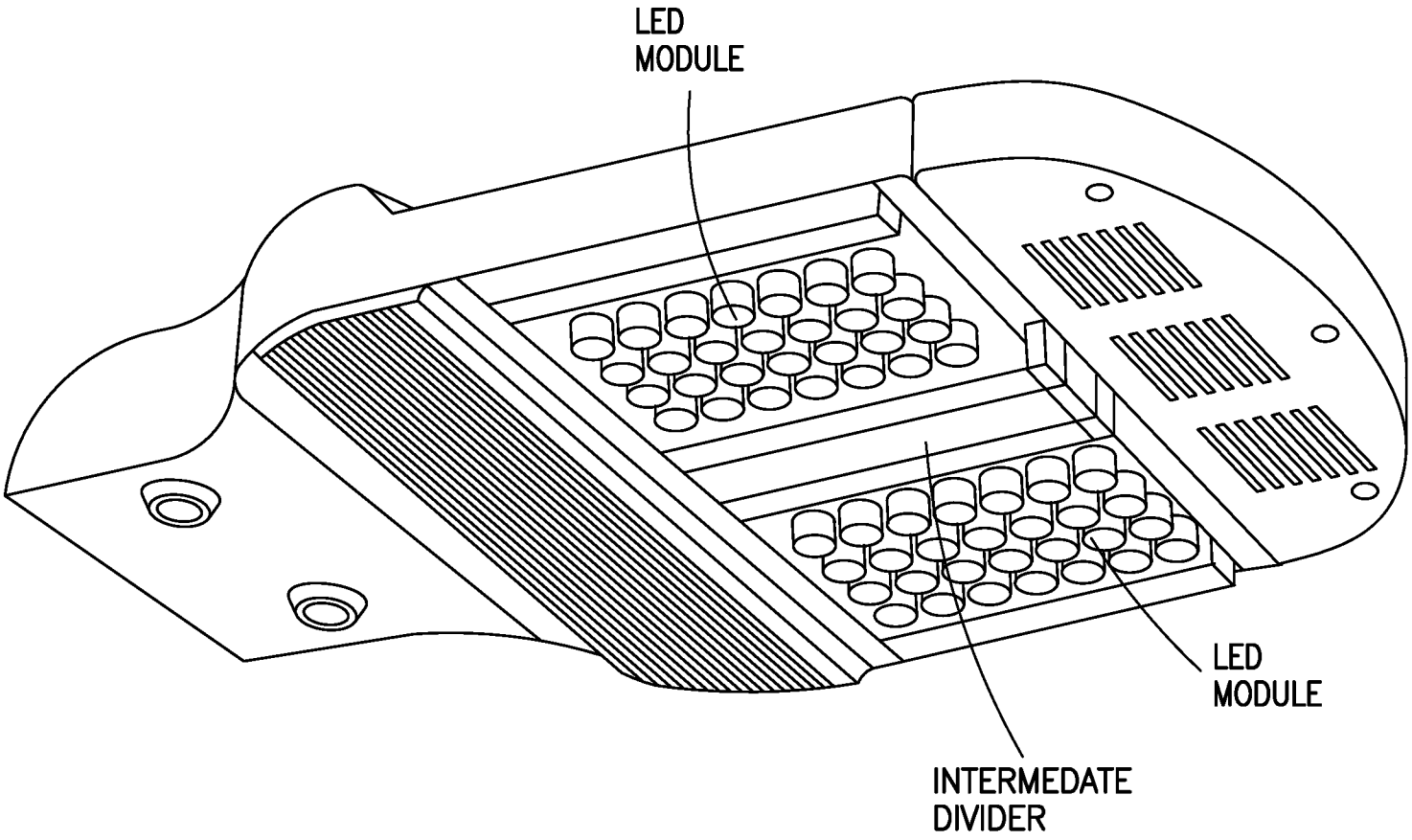

A LED lighting assembly 10 is provided herein which is useable for various applications and is particularly well-suited for street and other outdoor lighting applications. As will be recognized by those skilled in the art, the subject invention allows for arrays of different light modules to be provided mounted in different orientations with different throw resulting in different light distribution patterns. The different aspects of the invention described herein may be used singularly or in various combinations.

In a first embodiment, with reference to the Figures, the LED light assembly 10 generally includes a housing 12 and at least one lighting strip 14. The lighting strip 14 includes a plurality of LED light modules 16 arranged in axial end-to-end fashion. As a result, the lighting strip 14 has an elongated shape which extends between first and second ends 18, 20.

Each of the light modules 16 includes at least one heat dissipation block 22 and at least one LED element 24. The heat dissipation block 22 is formed of a heat conductive material such as aluminum or other metallic material. The LED element 24 may be of any known configuration, and may include one or more lighting elements. The LED element 24 may be provided as a board. The LED element 24 is secured to the heat dissipation body 22 so that heat from operation of the LED element 24 is drawn therefrom and dissipated by the heat dissipation block 22. The heat dissipation block 22 may be of various configurations including being defined by a plurality of fins 26. Optical lenses may be optionally provided with one or more of the light modules 16 to widen or otherwise distort the light generated by the LED elements 24.

The light modules 16 each include first and second ends 28, 30 which are axially aligned in defining the lighting strip 14. The ends 28, 30 of adjacent light modules 16 are joined using any known technique. For example, mechanical interlocking may be utilized wherein portions of the heat dissipation blocks 22 of adjacent light modules 16 are forcibly joined, such as through mechanical deformation. In addition, or alternatively, one or more joining elements 32 may be utilized, such as keys 34. The ends 28, 30 of the light modules 16 may be formed with slots 36 into which the keys 34 may be inserted to provide retentive force to couple together adjacent light module 16. The keys 34 and the slots 36 may have corresponding matching cross-sectional shapes, such as one or more dovetails. In addition, it is preferred that the keys 34 be shaped slightly larger than the corresponding slots 36 so that interference fits are provided.

One or more LED drivers may be accommodated inside the housing 12 as is known in the art. The drivers may be coupled with the LED element 24 in any known manner. Dimmers, light sensors, and other controls may be also provided.

The housing 12 may be of any known configuration and may include a mounting flange 38 or other mounting structure for mounting the LED light assembly 10 to a desired location. The mounting flange 38 may be adapted for surface mounting, wire mounting (e.g., wire suspended mounting), or pole mounting. In addition, the housing 12 defines at least one mounting surface 40 to which the lighting strip 14 is secured. Mounting features, such as screw holes, hooks, detents, and so forth may be provided which are configured to securingly engage the lighting strip 14.

It is preferred that the lighting strip 14 be secured to the housing 12 at the mounting surface 40 with one or more points of securement 42 located at mid-points along its length between the first and second ends 18, 20. The points of securement 42 may be at channels 44 formed in one or more of the heat dissipation blocks 22 of the LED modules 16. The channels 44 may be perpendicular to and/or parallel to the LED element 24 depending on the intended mounting orientation of the lighting strip 14 to the housing 12. For example, the lighting strip 14 may be mounted to project light generally perpendicularly from, or, alternatively, generally parallel to, the axis of mounting of the housing 12, e.g., through the mounting flange 38, to a target surface (e.g., wall mounted (light projection generally perpendicular to axis of mounting (FIG. 4A)), ceiling mounted (light projection generally parallel to axis of mounting (FIG. 4B))). Fasteners 46, such as screws, may be passed through the channels 44 to engage the housing 12. In addition, or alternatively, one or more channels 44 may pass through the keys 34.

Figure 14:
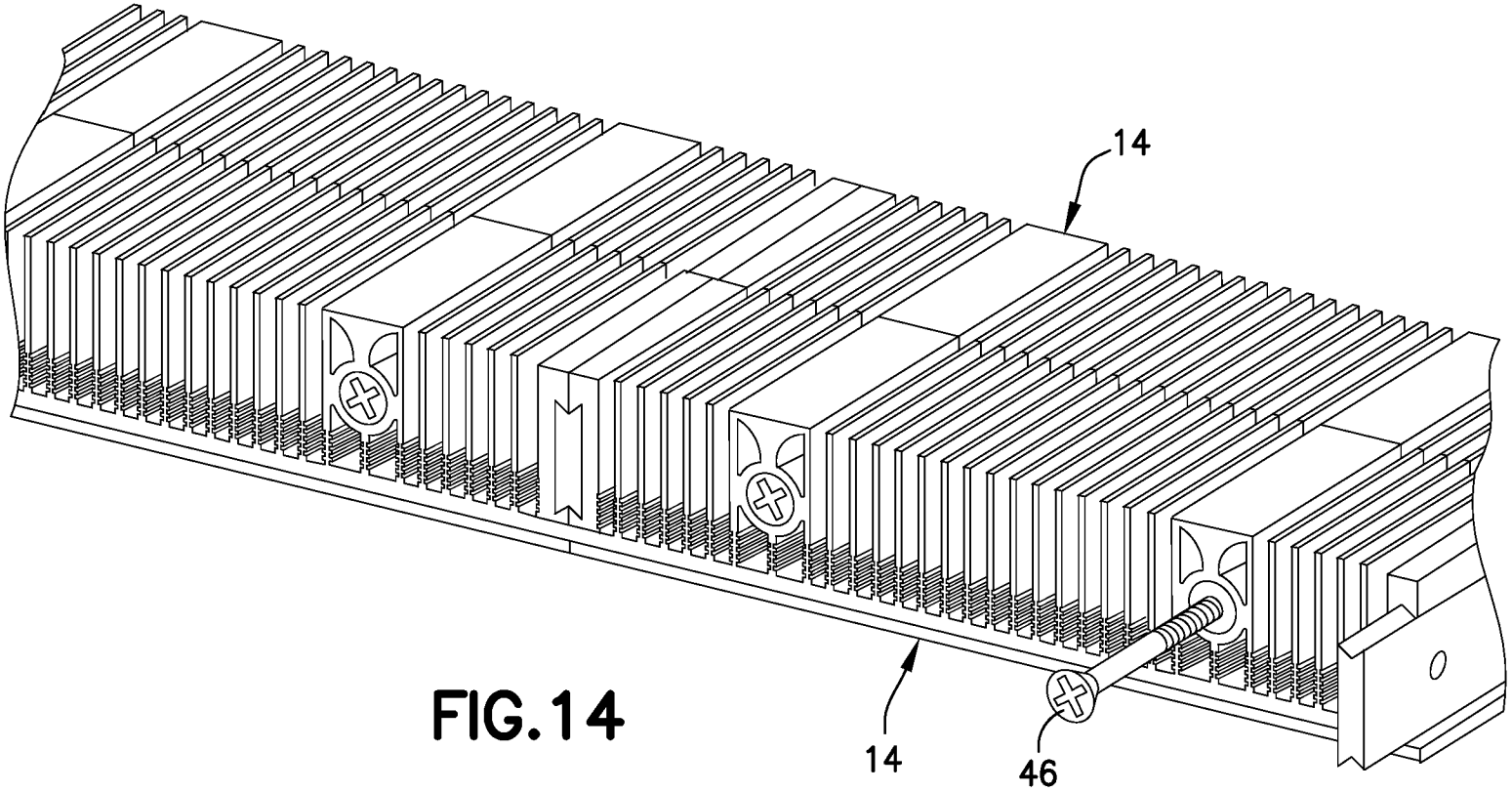

As will be appreciated by those skilled in the art, to provide for multi-column arrays of the light module 16, a plurality of lighting strips 14 may be arranged in general parallel fashion and secured to an adjacent lighting strip 14 and/or to the housing 12 (FIG. 14). For example, the channels 44 of a plurality of the lighting strips 14 may be aligned with fasteners 46 passing through each of the lighting strips 14 for providing securement. In addition, or alternatively, one or more of the keys 34 may be provided with sufficient length to pass through a plurality of pairs of the light modules 16 to retain a plurality of parallel sets of joined light modules 16 (FIG. 14). The keys 34 and/or the fasteners 46 may be used to secure adjacent pairs of the lighting strips 14 in various combinations.

To provide additional stability, one or more straps 48 may be secured from the housing 12 to the first and/or second ends 18, 20 of one or more of the lighting strips 14. The one or more straps 48 may be used to secure one or more of the lighting strips 14 to the housing 12. The straps 48 may generate a force which presses one or more of the lighting strips 14 against the housing 12, e.g., pressing against at least one mounting surface 40, sufficiently to provide retention thereof. In this manner, additional mounting features may be optionally avoided.

Figure 4:
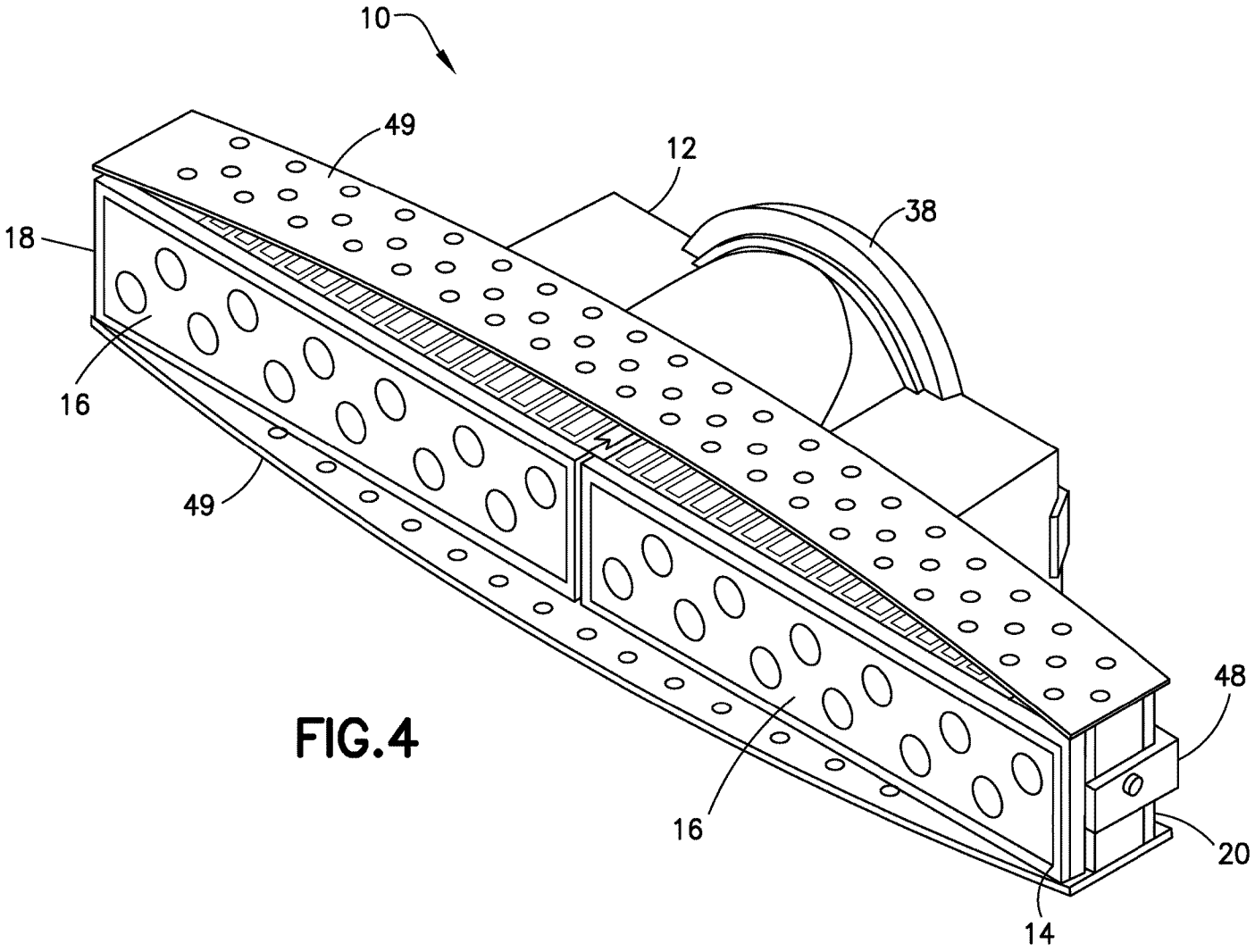
FIGS. 4-21 show various aspects of the subject invention.
Figure 4B:
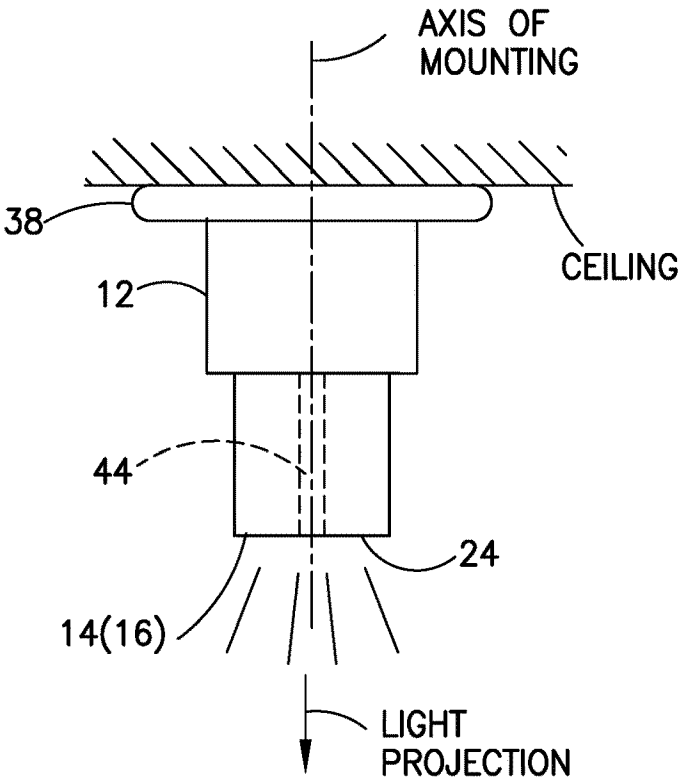
Figure 4A:
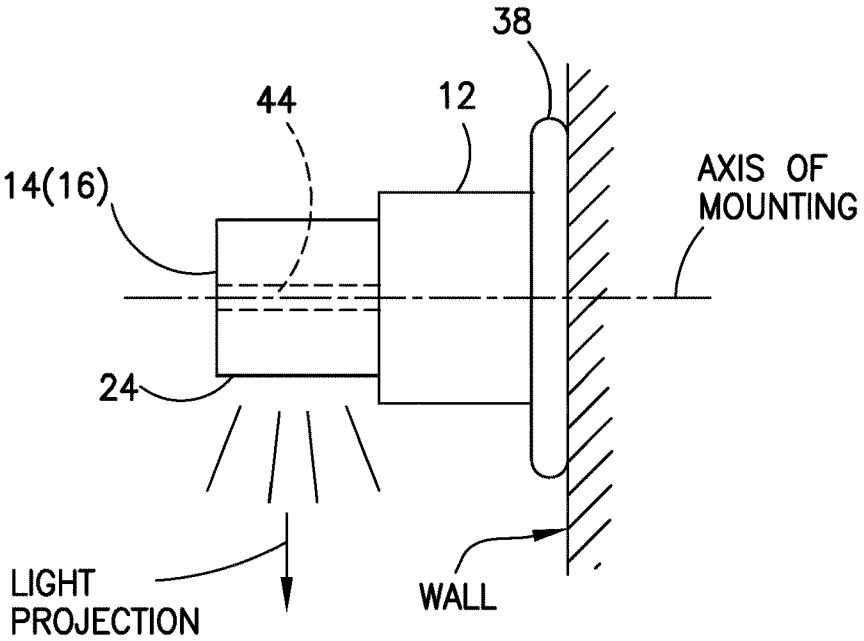
Figure 5:
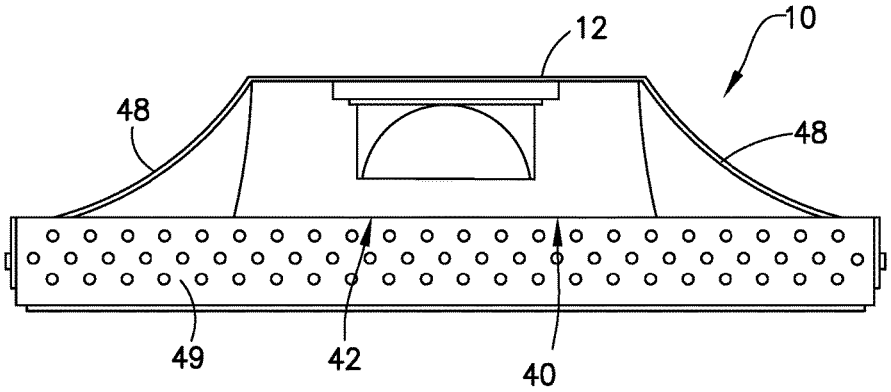
Figure 6:
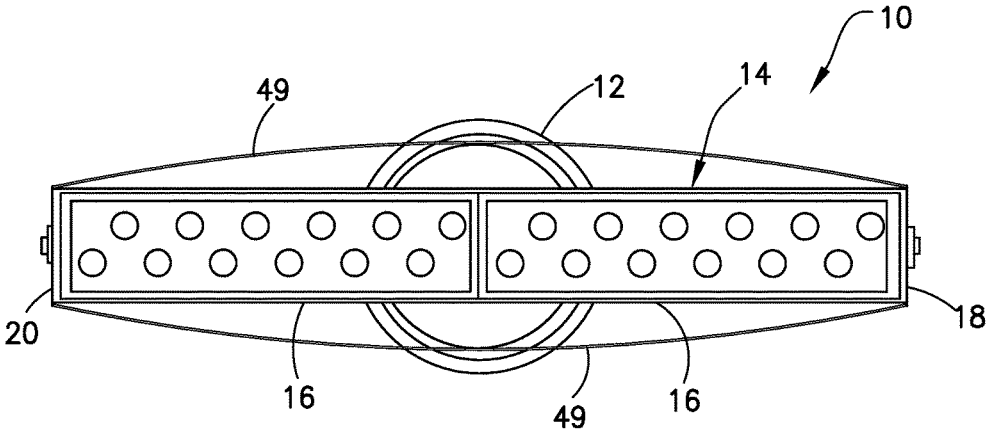
Figure 7:
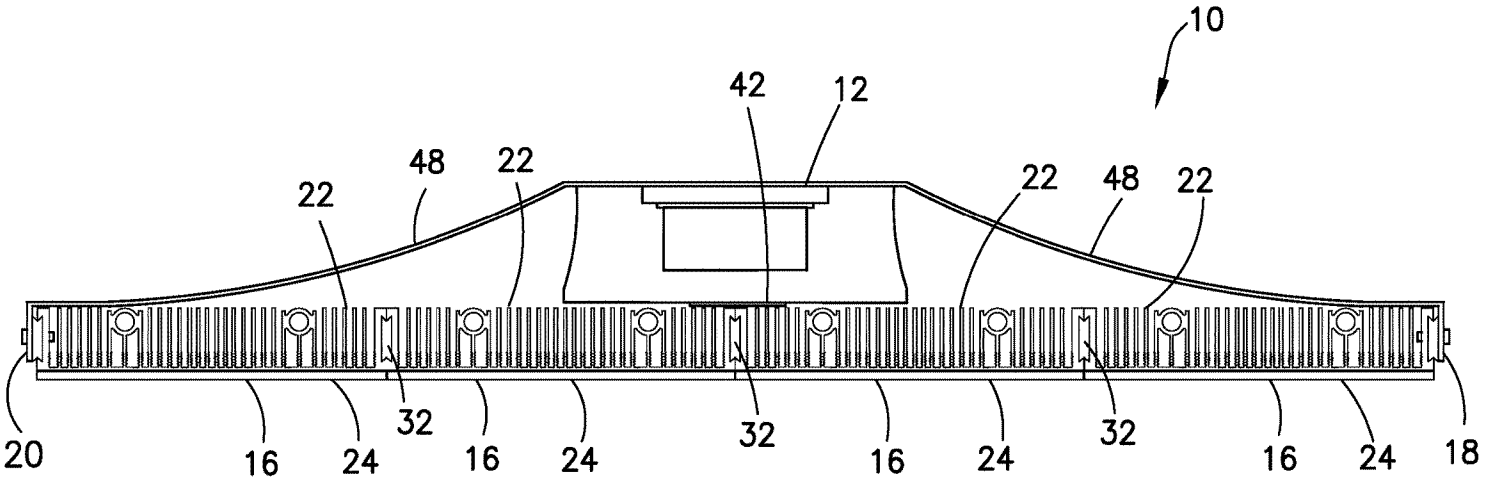
Figure 8:
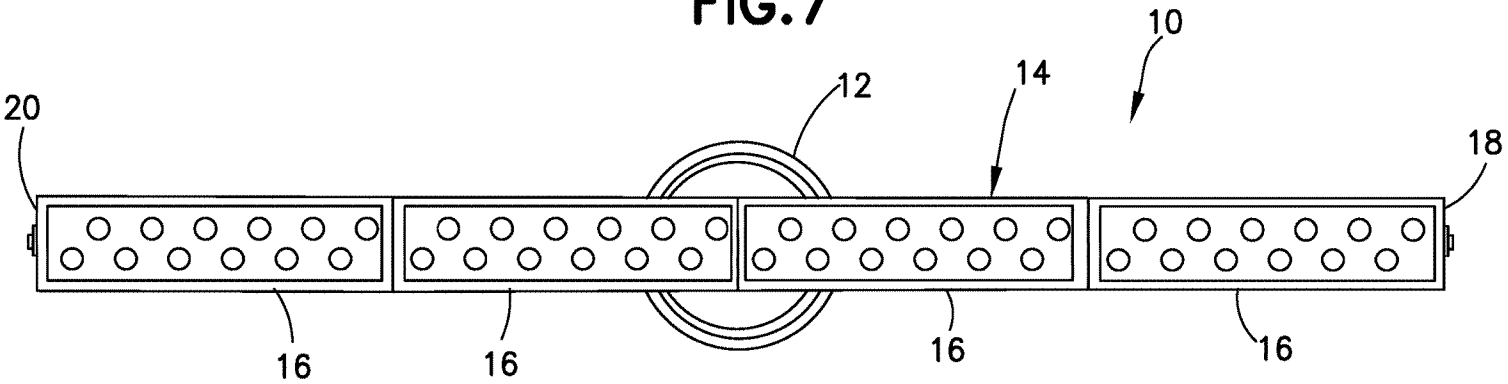
Figure 9:
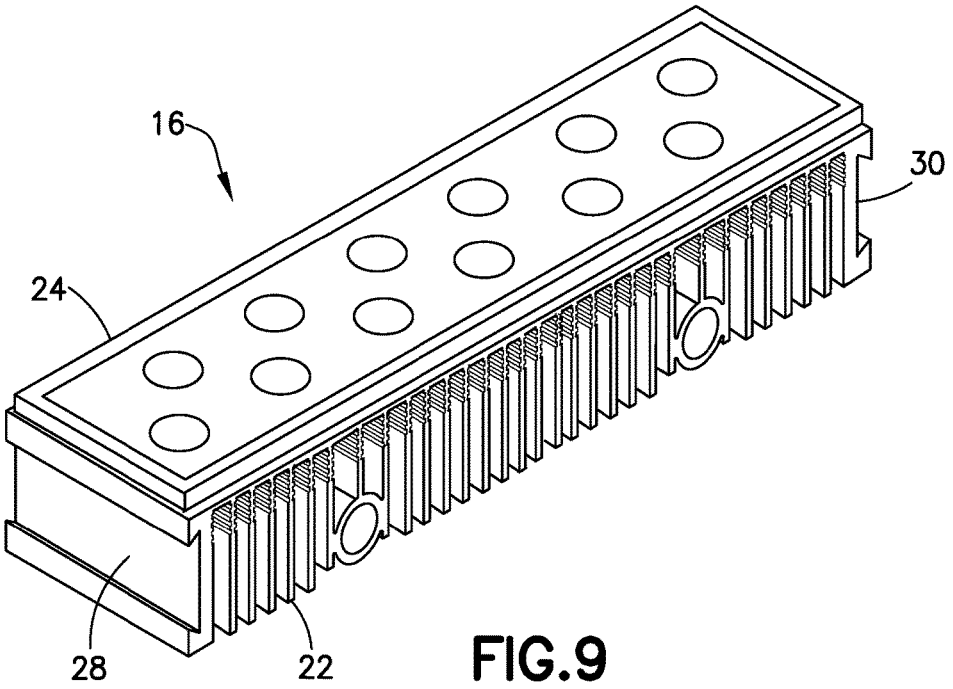
Figure 10:
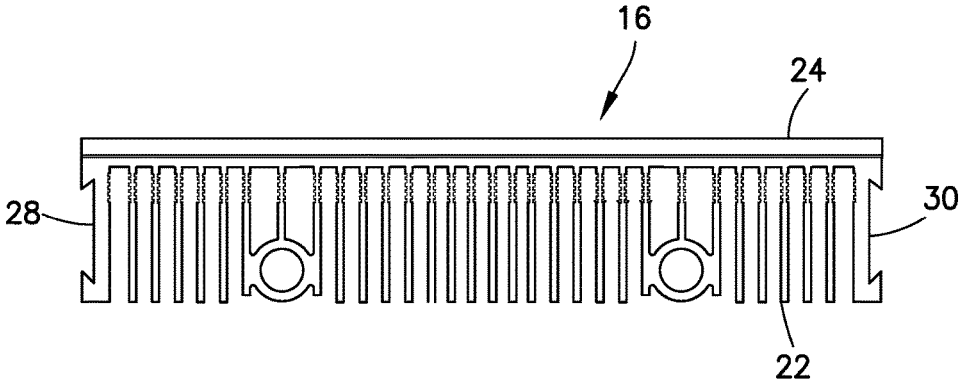
Figure 11:
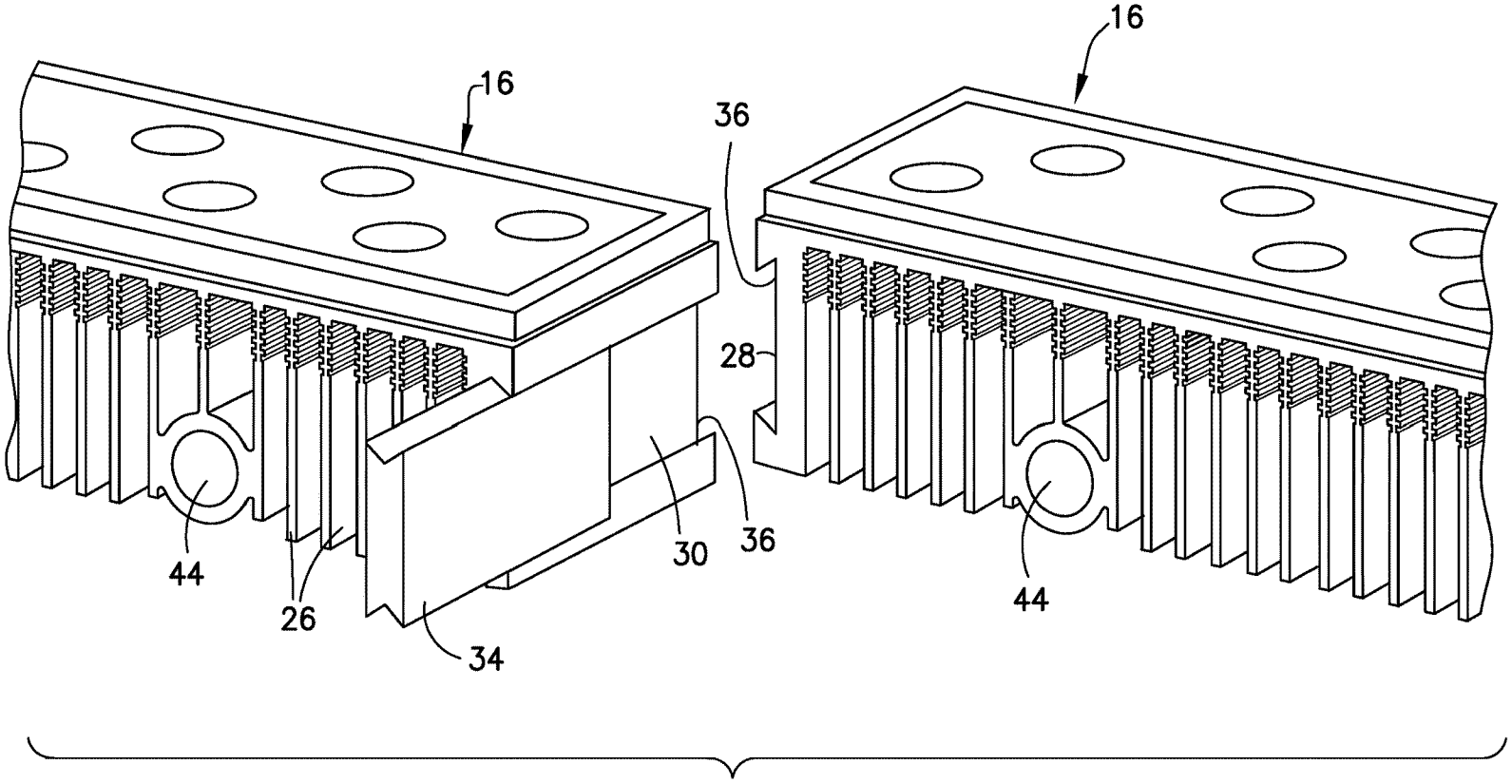
Figure 12:
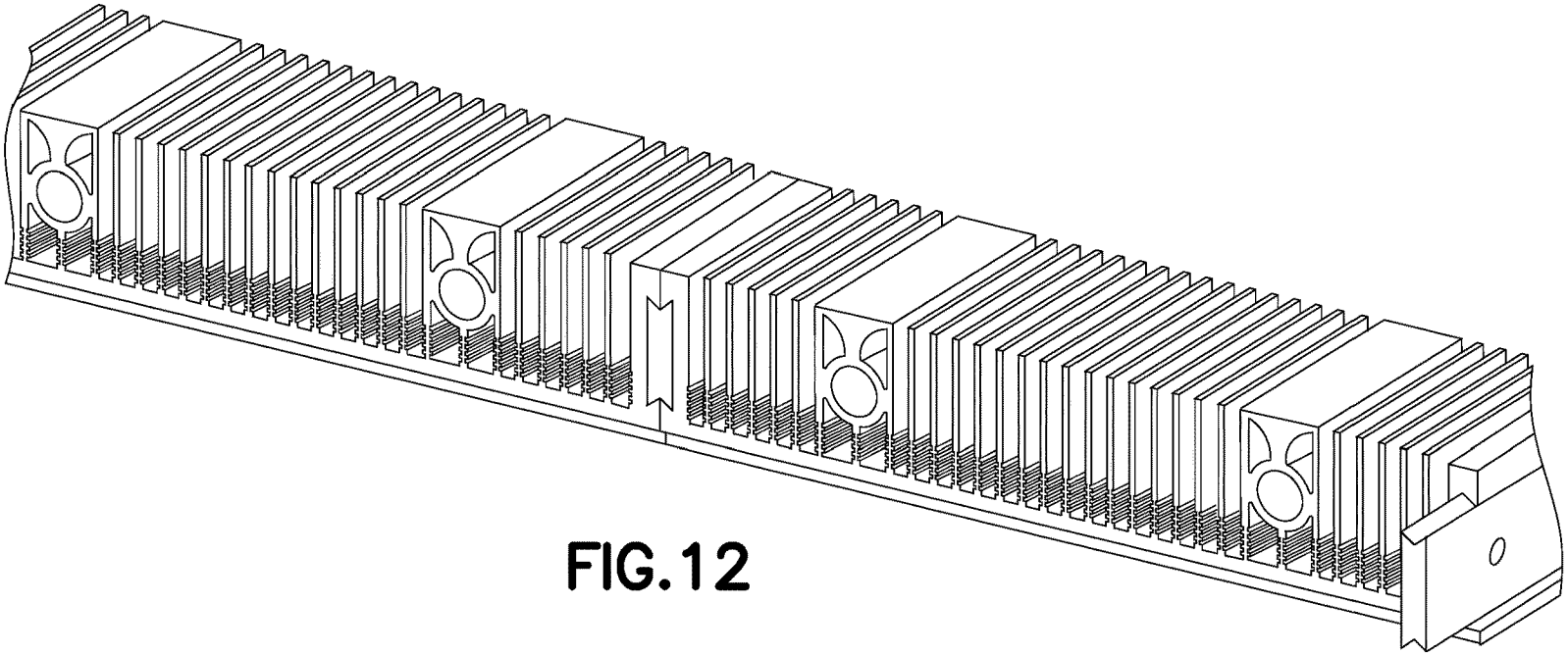
Figure 13:
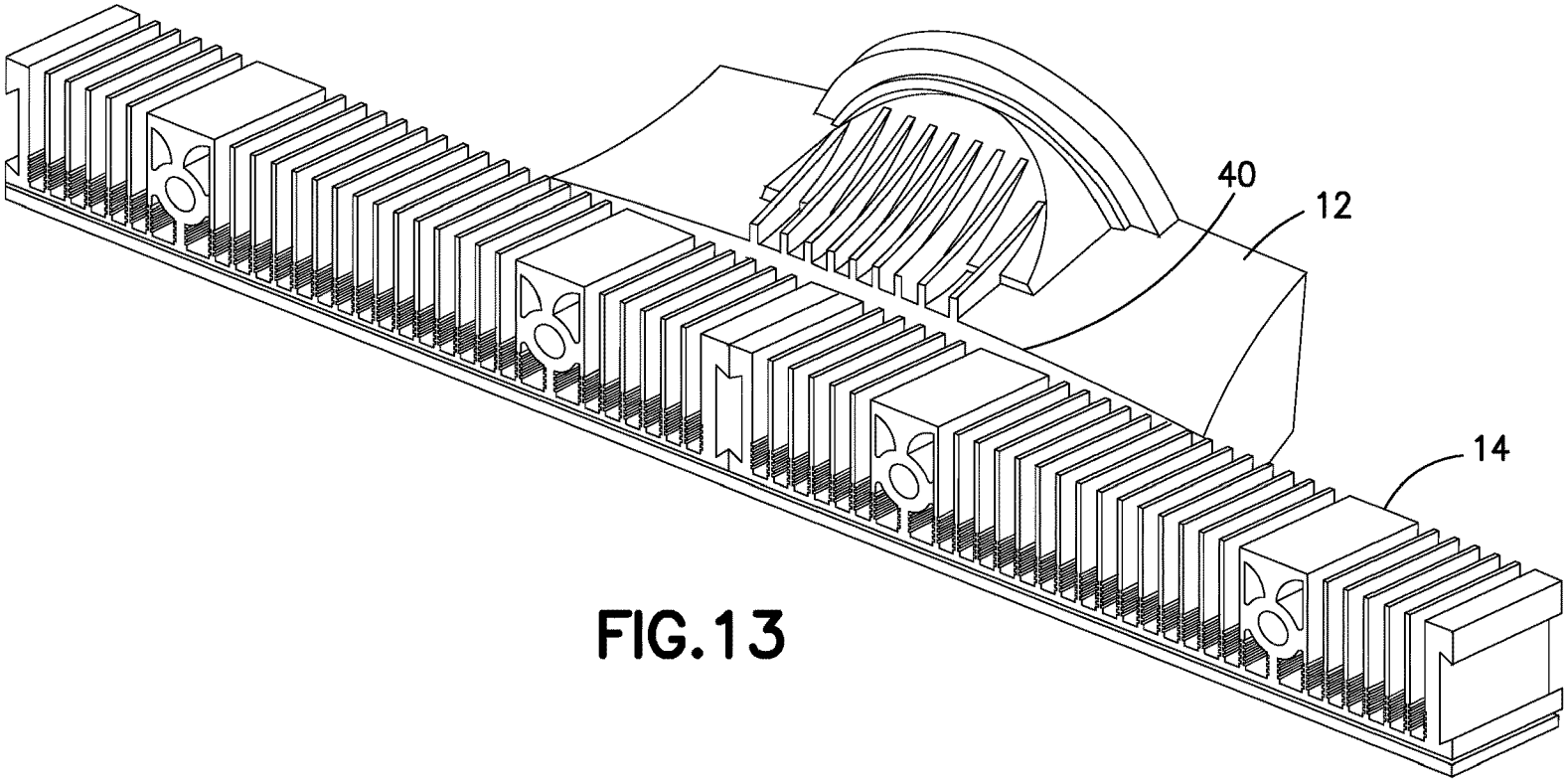

One or more spacers may be provided between adjacent pairs of the lighting strips 14 to permit air flow therebetween. In addition, as shown in FIGS. 4-6, decorative strips 49 may be provided along one or more sides of the lighting strip 14 to provide a more aesthetically appealing look for the LED lighting assembly 10. The decorative strips 49 preferably are spaced from the heat dissipation blocks 22 to not restrict air flow therepast. The decorative strips 49 may be perforated to allow air flow therethrough. The decorative strips 49 may be metallic and/or non-metallic.

As will be understood by those skilled in the art, the fasteners 46 need not be threaded to provide securement to the housing 12. The fasteners 46 may be secured to the housing 12 with various interconnections, such as bayonet locking, friction fit, and so forth.

Figure 15:
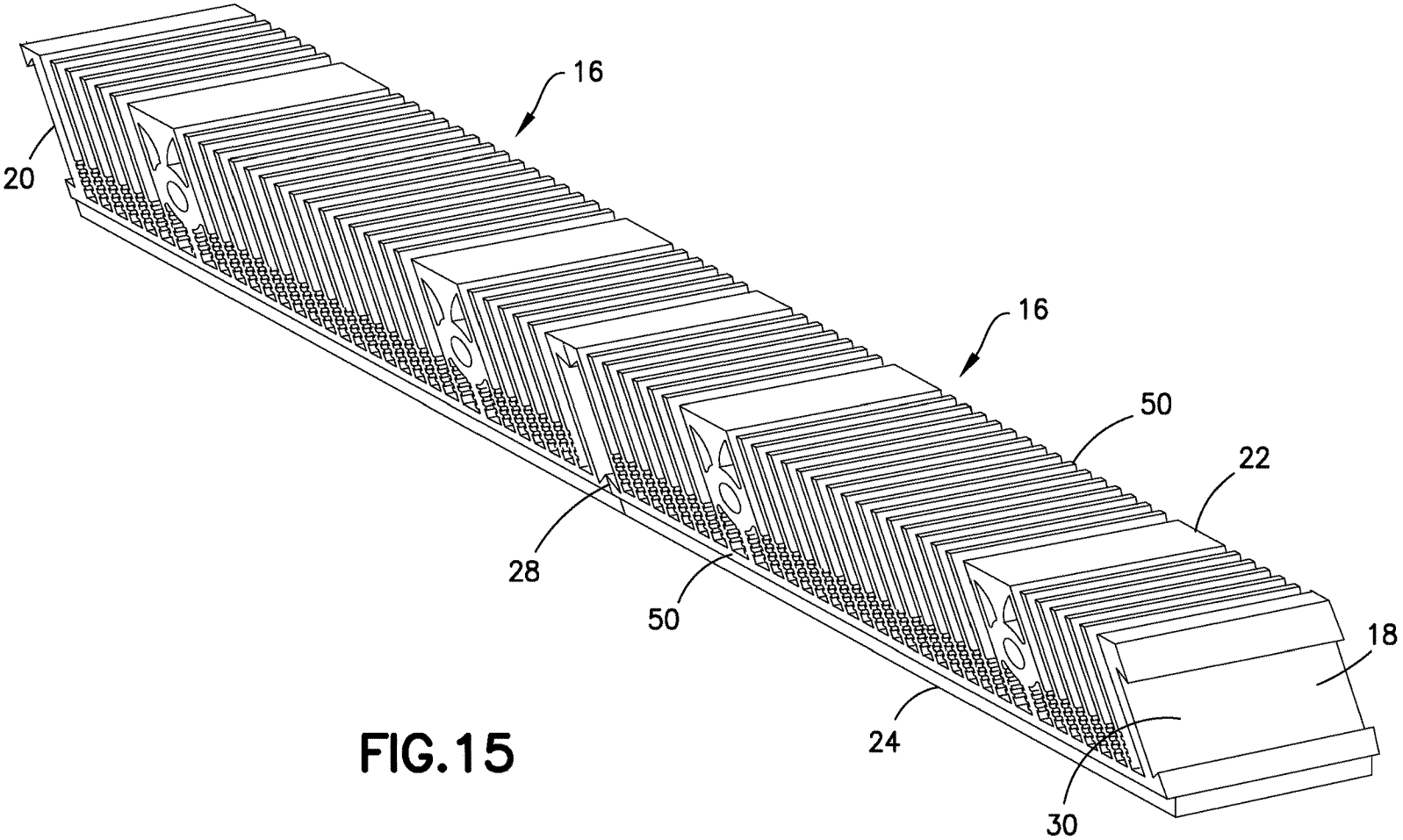
Figure 17:
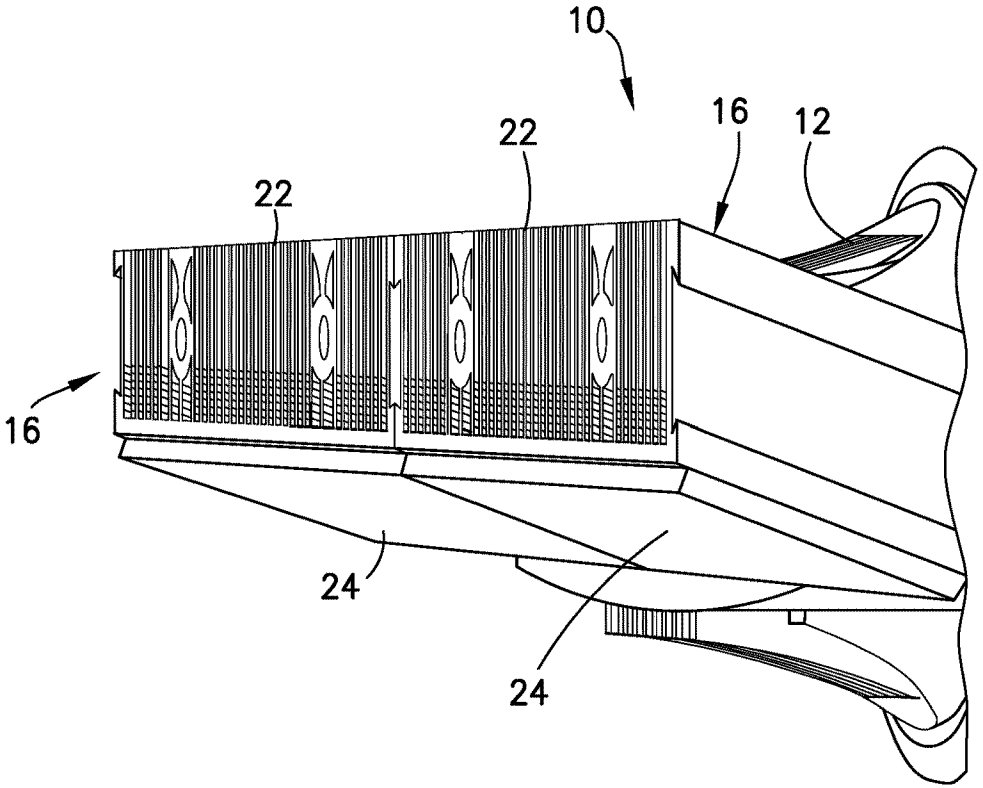
Figure 16:
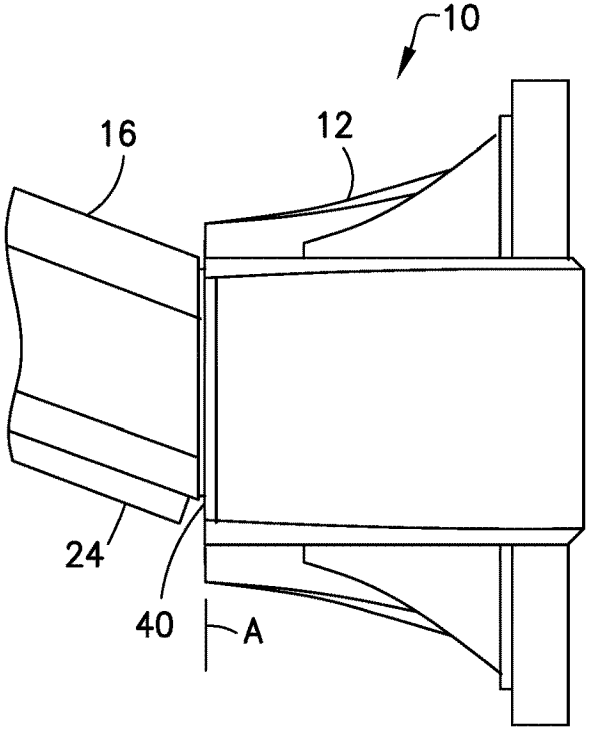
Figure 18:
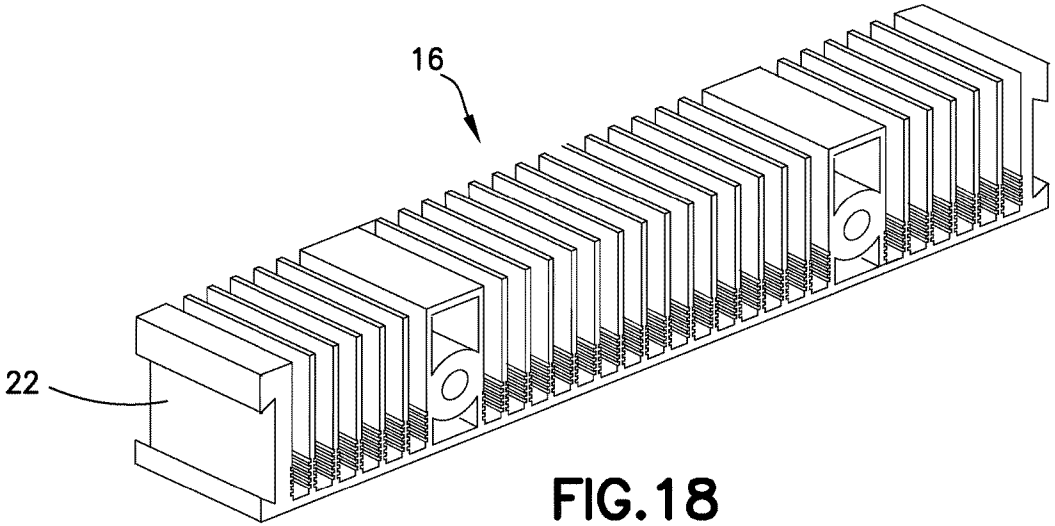
Figure 19:
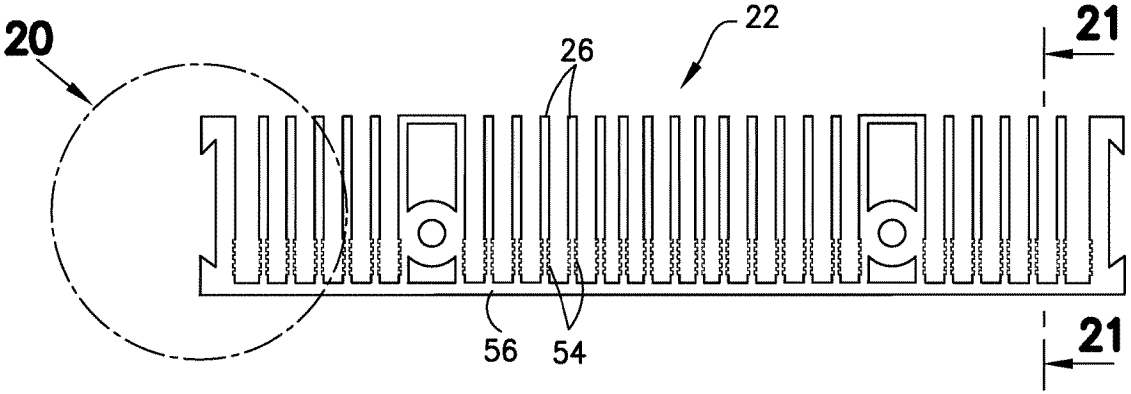
Figure 21:
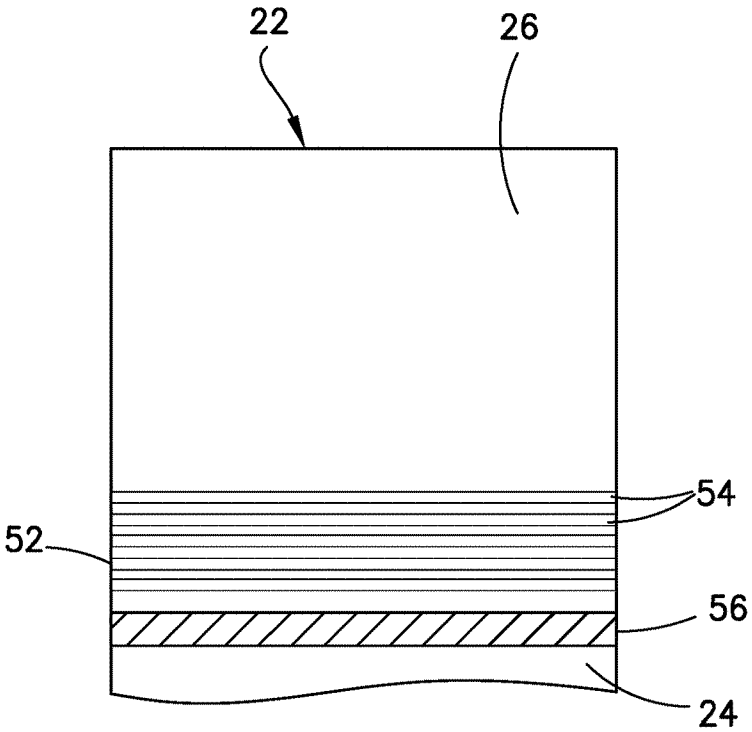
Figure 20:
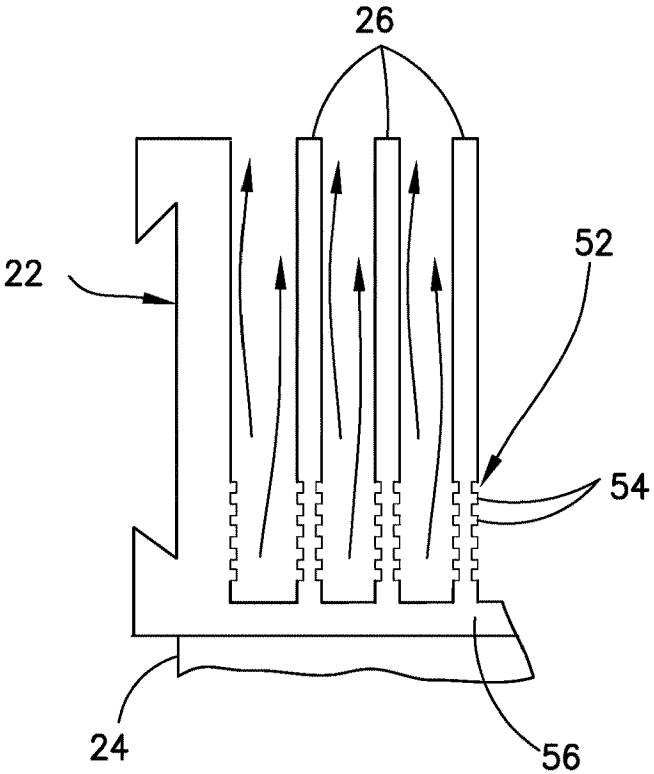

With reference to FIGS. 15-17, one or more of the LED light modules 16 may be canted so as to have angled faces 50 between its ends 18, 20. As best shown in FIG. 16, with the canted light module 16 being placed against the mounting surface 40, the LED element 24 is disposed to not be perpendicular to the plane A of the mounting surface 40. Face-to-face engagement may be provided between the canted light module 16 and the mounting surface 40 to allow for stable securement of the canted light module 16 to the housing 12. This allows for additional throw to be provided for the canted light module 16. The additional throw may obviate the need for an optical lens (e.g., a larger light distribution pattern may be achieved without the need for optical lenses).

The housing 12 may be shaped as a prior art frame-shaped housing described above. One or more lighting strips 14 may be edge supported by the frame without need for intermediate dividers. In this manner, a plurality of the light modules 16 coupled together in axial end-to-end fashion may be provided to span the frame without requiring mid-span support from intermediate divider(s).

With reference to FIGS. 18-21, portions 52 of the heat dissipation block 22 may be formed with protrusions 54 to increase heat dissipation. It is preferred that the portions 52 be located in proximity to base 56 to which the LED element 24 is secured. The fins 26 may extend from the base 56 opposite from the LED element 24. In this manner, heat is drawn for the LED element 24 by the base 56 to the fins 26.

The portions 52 may be defined on the fins 26 adjacent to the base 56. Preferably, the portions 52 extend only partially along the fins 26 near the base 56. It is preferred that the protrusions 54 be disposed along a limited length of the fins 26 extending from the base 56. With this arrangement, greater heat dissipation may be achieved adjacent to the base 56. With the escaping of this dissipated heat between the fins 26, greater heat dissipation may be achieved along the full length of the fins 26. The heat escaping between the fins 26 will cause air flow along the fins 26 with such air flow causing additional heat dissipation along the length of the fins 26.

The portions 52 may be of various configurations which increase surface area of the fins 26. By way of non-limiting example, the portions 52 may be fin-shaped. The portions 52 may be continuous or discontinuous and extend in various directions (away from the base 56, parallel to the base 56, oblique to the base 56, random or irregular directions, and so forth).

The different aspects herein (the lighting strip; channel mid-support; canting; protrusions) may be used singularly or in any combination.

What is claimed:

1. An LED light assembly comprising:

a housing including a mounting wall;

a plurality of elongated LED light modules coupled together in axial end-to-end fashion so as to define an elongated lighting strip extending along a longitudinal axis, each said LED light module including at least one heat dissipation block and at least one LED element, said lighting strip being secured to said mounting wall of said housing; and, at least one joining element, wherein, a first slot being formed transversely across a first end of a first heat dissipation block of a first of said LED light modules, a second slot being formed transversely across a first end of a second heat dissipation block of a second of said LED light modules, wherein, said first slot being in open communication with said second slot to receive said at least one joining element from outside the first and second LED light modules with: i. said first ends being adjacent; and, ii. said first and second LED light modules being longitudinally aligned along said longitudinal axis in contiguous contact, and, wherein, said first and second LED light modules being coupled together in axial end-to-end fashion with said at least one joining element being advanceable into, and simultaneously received in, said first and second slots, and wherein, said first and second heat dissipation blocks are canted so that with securement of said first and second heat dissipation blocks to said mounting wall, said LED elements of said first and second light modules are disposed in a plane not perpendicular to a plane of said mounting wall.

2. An LED light assembly as in claim 1, wherein said lighting strip has longitudinally disposed first and second ends, said lighting strip including at least one point of securement located between said first and second ends used to secure said lighting strip to said mounting wall.

3. An LED light assembly as in claim 1, further comprising a second elongated lighting strip defined by a plurality of LED light modules coupled together in axial end-to-end fashion, said second lighting strip being disposed generally parallel to said lighting strip.

4. An LED assembly as in claim 3, wherein said second lighting strip is secured to said lighting strip.

5. An LED assembly as in claim 4, wherein said second lighting strip is secured to said housing.

6. An LED element assembly as in claim 1, wherein said housing includes a frame having spaced-apart first and second side edges, an open lighting window being at least partially bound by said first and second side edges.

7. An LED assembly as in claim 6, wherein said lighting strip has longitudinally disposed first and second ends, and wherein said lighting strip is secured to said housing with:

said first end engaging said first side edge, said second end engaging said second side edge, and said LED elements being positioned to transmit light through said lighting window.

8. An LED light assembly as in claim 1, wherein said first and second LED light modules are coupled together through mechanical interlocking.

9. An LED light assembly as in claim 1, wherein said at least one joining element is received in said first and second slots in an interference fit.

10. An LED light assembly comprising:

a housing including a mounting wall;

a plurality of elongated LED light modules coupled together in axial end-to-end fashion so as to define an elongated lighting strip extending along a longitudinal, each said LED light module including at least one heat dissipation block and at least one LED element, at least one channel being defined through said heat dissipation block;

at least one support formed to pass through said at least one channel of at least one of said LED light modules to provide support therefor; and, at least one joining element, wherein, a first slot being formed transversely across a first end of a first heat dissipation block of a first of said LED light modules, a second slot being formed transversely across a first end of a second heat dissipation block of a second of said LED light modules, wherein, said first slot being in open communication with said second slot to receive said at least one joining element from outside the first and second LED light modules with: i. said first ends being adjacent; and, ii. said first and second LED light modules being longitudinally aligned along said longitudinal axis in contiguous contact, and, wherein, said first and second LED light modules being coupled together in axial end-to-end fashion with said at least one joining element being advanceable into, and simultaneously received in, said first and second slots, and wherein, said first and second heat dissipation blocks are canted so that with securement of said of said first and second heat dissipation blocks to said mounting wall, said LED elements of said first and second light modules are disposed in a plane not perpendicular to a plane of said mounting wall.

11. An LED light module as in claim 1, wherein said first heat dissipation block of said first LED light module includes a base and a plurality of fins extending from said base.

12. An LED light module as in claim 11, wherein portions of at least one fin of said plurality of fins adjacent to said base defines protrusions.

13. An LED light module as in claim 12, wherein said protrusions are fin-shaped.

14. An LED light module as in claim 12, wherein said protrusions are disposed along a limited length of said at least one fin extending from said base.

* * * * *